US010622140B2

(12) United States Patent
Tridico et al.

(10) Patent No.: US 10,622,140 B2
(45) Date of Patent: Apr. 14, 2020

(54) HIGH VOLTAGE CONTACT FOR AN IGNITION COIL

(71) Applicant: BorgWarner Ludwigsburg GmbH, Ludwigsburg (DE)

(72) Inventors: Francesco Tridico, Asperg (DE); Timo Stifel, Stuttgart (DE); Manfred Adolf, Schwaikheim (DE); Dirk Wüstenhagen, Auma (DE); Sven Schumm, Walheim (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 225 days.

(21) Appl. No.: 15/654,368

(22) Filed: Jul. 19, 2017

(65) Prior Publication Data

US 2018/0025837 A1 Jan. 25, 2018

(30) Foreign Application Priority Data

Jul. 21, 2016 (DE) ..... 10 2016 113 450

(51) Int. Cl.

| | |
|---|---|
| ***H01F 38/12*** | (2006.01) |
| ***F02P 3/04*** | (2006.01) |
| ***H01F 27/29*** | (2006.01) |
| ***H01F 27/28*** | (2006.01) |
| ***F02P 13/00*** | (2006.01) |
| ***H01F 27/40*** | (2006.01) |
| *F02P 3/05* | (2006.01) |
| *F02P 15/00* | (2006.01) |

(52) U.S. Cl.

CPC ..... *H01F 38/12* (2013.01); *F02P 3/04* (2013.01); *F02P 13/00* (2013.01); *H01F 27/2828* (2013.01); *H01F 27/29* (2013.01); *H01F 27/40* (2013.01); *F02P 3/051* (2013.01); *F02P 15/008* (2013.01)

(58) Field of Classification Search

CPC ..... H01F 38/12; H01F 27/40; H01F 27/29; F02P 13/00; F02P 3/051; F02P 15/008

See application file for complete search history.

(56) References Cited

U.S. PATENT DOCUMENTS

| | | | | |
|---|---|---|---|---|
| 5,394,302 A * | 2/1995 | Trautwein | H01F 38/12 336/107 |
| 5,714,922 A * | 2/1998 | Suzuki | F02P 13/00 123/634 |
| 7,753,038 B2 * | 7/2010 | Nakao | H01F 27/29 123/634 |
| 10,037,846 B2 * | 7/2018 | Akimoto | H01F 38/12 |
| 10,283,263 B2 * | 5/2019 | Tridico | F02P 3/04 |
| 2013/0284157 A1 * | 10/2013 | Deguchi | F02P 23/00 123/634 |

(Continued)

FOREIGN PATENT DOCUMENTS

| | | |
|---|---|---|
| DE | 10 2010 027 945 A1 | 10/2011 |
| JP | 2011-077485 A | 4/2011 |

*Primary Examiner* — David Hamaoui

(74) *Attorney, Agent, or Firm* — Bose McKinney & Evans LLP

(57) ABSTRACT

Described is an ignition coil comprising a housing, in which a transformer is arranged, and a plug connector, wherein the plug connector has a high voltage contact, which is connected to the secondary side of the transformer by means of a wire, which resiliently presses against an electrical contact surface. The contact surface is concavely shaped.

14 Claims, 4 Drawing Sheets

(56) References Cited

U.S. PATENT DOCUMENTS

| | | | | |
|---|---|---|---|---|
| 2014/0226253 | A1* | 8/2014 | Kawai | F02P 3/02<br>361/263 |
| 2018/0254144 | A1* | 9/2018 | Kawai | F02P 15/00 |
| 2019/0162156 | A1* | 5/2019 | Kondo | F02P 3/055 |

* cited by examiner

HIGH VOLTAGE CONTACT FOR AN IGNITION COIL

RELATED APPLICATIONS

This application claims priority to DE 10 2016 113 450.3, filed Jul. 21, 2016, the entire disclosure of which is hereby incorporated herein by reference in its entirety.

BACKGROUND

The invention relates to an ignition coil of the type generally known from DE 10 2010 027 945 A1.

Ignition coils comprise a plug connector, which is slipped on a spark plug. This plug connector has a high voltage contact for contacting the spark plug. This contact must be electrically connected to the secondary side of the transformer of the ignition coil, which can be accomplished with a soldered or welded connection. DE 10 2010 027 945 A1 discloses an alternative solution for establishing an electrical connection of the contact of a plug connector to the secondary side of the transformer, namely by pressing a wire against an electrical contact surface by means of a contact spring that has an electrically nonconductive carrier element.

SUMMARY

This disclosure shows how an ignition coil of the kind mentioned above can be more easily manufactured.

In an ignition coil according to this disclosure, a piece of wire by means of which a high-voltage contact of the plug connector is electrically connected to the secondary side of the transformer is pressed against a concave contact surface of the plug connector. The contact surface may be provided as an indention or recess and may, e.g., be cup-shaped. The concave shape of the contact surface may, for example, be provided by an annular bead that rises in the plugging direction of the plug connector, guides an end of the wire during assembly of the ignition coil to a location that is surrounded by the bead, thus eliminating the need for additional components, such as in particular a separate contact spring. The spring force of the wire itself is sufficient for maintaining an electrical contact between the wire and the concave contact surface.

An advantageous refinement of this disclosure comprises that an end surface of the wire presses against the contact surface. The contact location itself is then surrounded and screened by the concave shape of the contact surface, for example, the annular bead. Any field peaks at the contact location are thus less problematical. The end surface is preferably rounded, for example, spherically rounded. Rounding the end surface prevents field peaks. The wire itself may be rounded or a ball can be placed onto the wire end in order to provide a rounded end surface.

Another advantageous refinement of this disclosure comprises that the end surface of the wire is resiliently against both a bottom and an inside wall of the cup-shaped contact surface. In this way the area of contact between the wire and the contact surface can be increased, especially if the radius of curvature between the wall and the bottom of the contact surface is smaller than the radius of curvature of the rounded end surface of the wire.

Another advantageous refinement is that the electrical contact surface is provided as a circular groove. The wire is then inserted into the groove. Thereby a large area of contact is achieved.

Another advantageous refinement of this disclosure comprises that the wire is bent in the shape of an L, so that an end section of the wire pressing against the contact surface confines an acute angle with the plugging direction of the plug connector of less than 30°, preferably of no more than 20°. The end section of the wire can be aligned in the plugging direction toward the middle of the contact surface or towards the middle of a tubular housing section, in which the high-voltage contact rests. An angle between the plugging direction and end section of the wire that is relatively small by comparison to the contacting in DE 10 2010 027 945 A1 facilitates a stronger spring force with which the wire presses against the contact surface.

Another advantageous refinement of this disclosure comprises that the high-voltage contact is a rod, which has the contact surface at its end facing the transformer. Such a high-voltage contact can be readily inserted into a tubular section of the housing in order to form a plug connector. For example, the high-voltage contact can rest in an electrically insulating sleeve that is pressed into the housing.

The contact surface can be designed as a cap placed on the rod. This makes it possible to cost-effectively fabricate a concavely shaped contact surface out of sheet metal, in particular with an annular bead rising in the plugging direction. Such a cap can also be placed on the end facing away from the transformer, so as to contact a spark plug onto which the connecting plug is slipped.

For example, the rod can be an interference resistor or contain an interference resistor. The interference resistor can be a ceramic resistor or be made of glass containing electrically conductive particles.

Another advantageous refinement of this disclosure provides that the wire is a lead of a diode arranged between the high-voltage contact and the secondary side of the transformer. This enables an especially cost-effective fabrication, since the diode is also used for high-voltage contacting and hence no additional components are needed for this purpose.

In a method according to this disclosure for manufacturing an ignition coil, of a transformer is inserted into a housing, which has a tubular section for forming a plug connector. Before or after insertion, a piece of wire bent into an L-shaped is electrically connected with the secondary side of the transformer. Preferably the piece of wire is the lead of a diode. One end section of the L-shaped wire is thereby aligned in such a way that the end section includes an acute angle with a longitudinal direction of the tubular section, preferably an angle of less than 30°. The plug connector for the spark plug is then formed by inserting a high-voltage contact into the tubular section of the housing, so that a concave contact surface of the high-voltage contact is pressed against an end surface of the wire. The housing is then filled with casting resin. The spring force of the wire is usually strong enough to maintain the electrical contact between the contact surface and the wire during the filling of the housing with casting resin. However, if a film comprised of casting resin should form between the contact surface and the wire, the latter is readily bridged at rather low voltages, thereby re-establishing the electrical contact.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
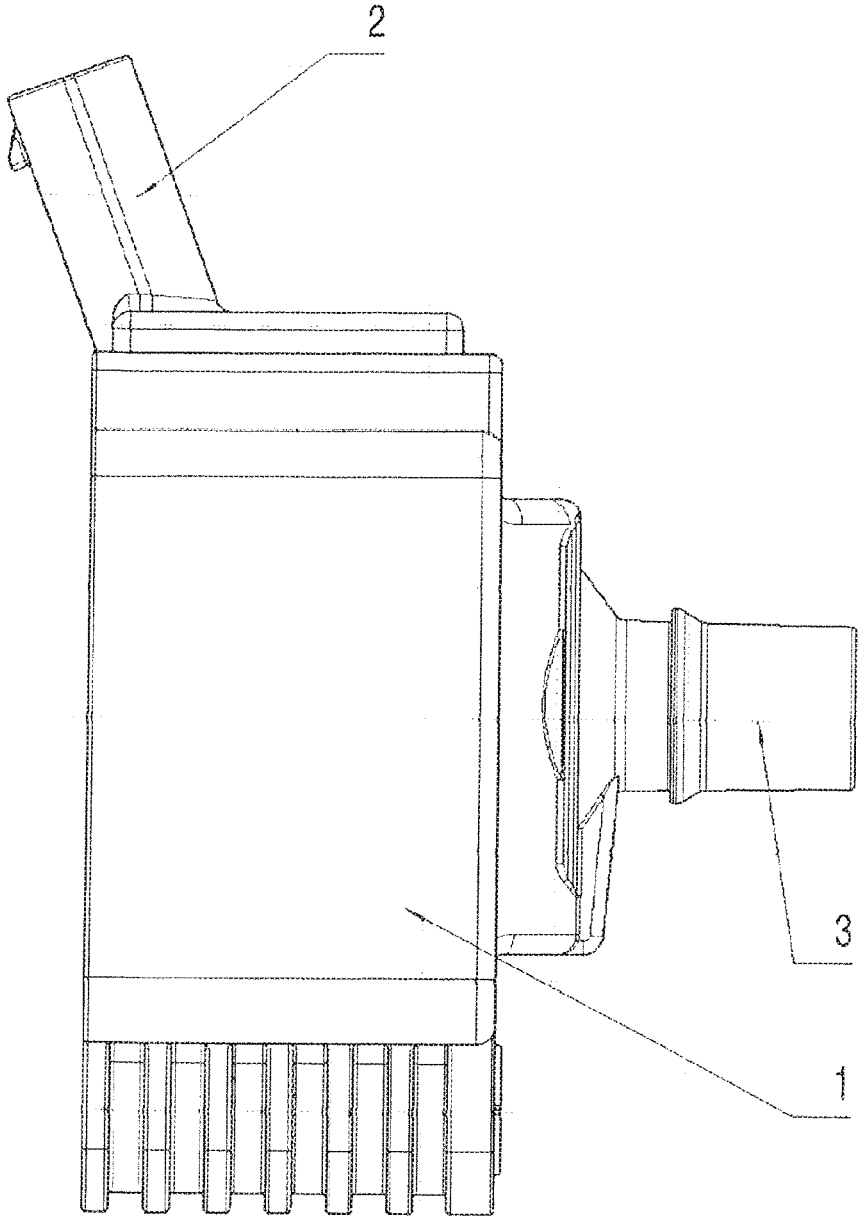
FIG. 1 is a schematic view of an ignition coil according to this disclosure.

The ignition coil shown in FIG. 1 comprises a housing 1 with a first plug connector 2 for connection to a power source, for example, the electrical system of a vehicle, and a second plug connector 3 for slipping onto a spark plug.

Figure 2:
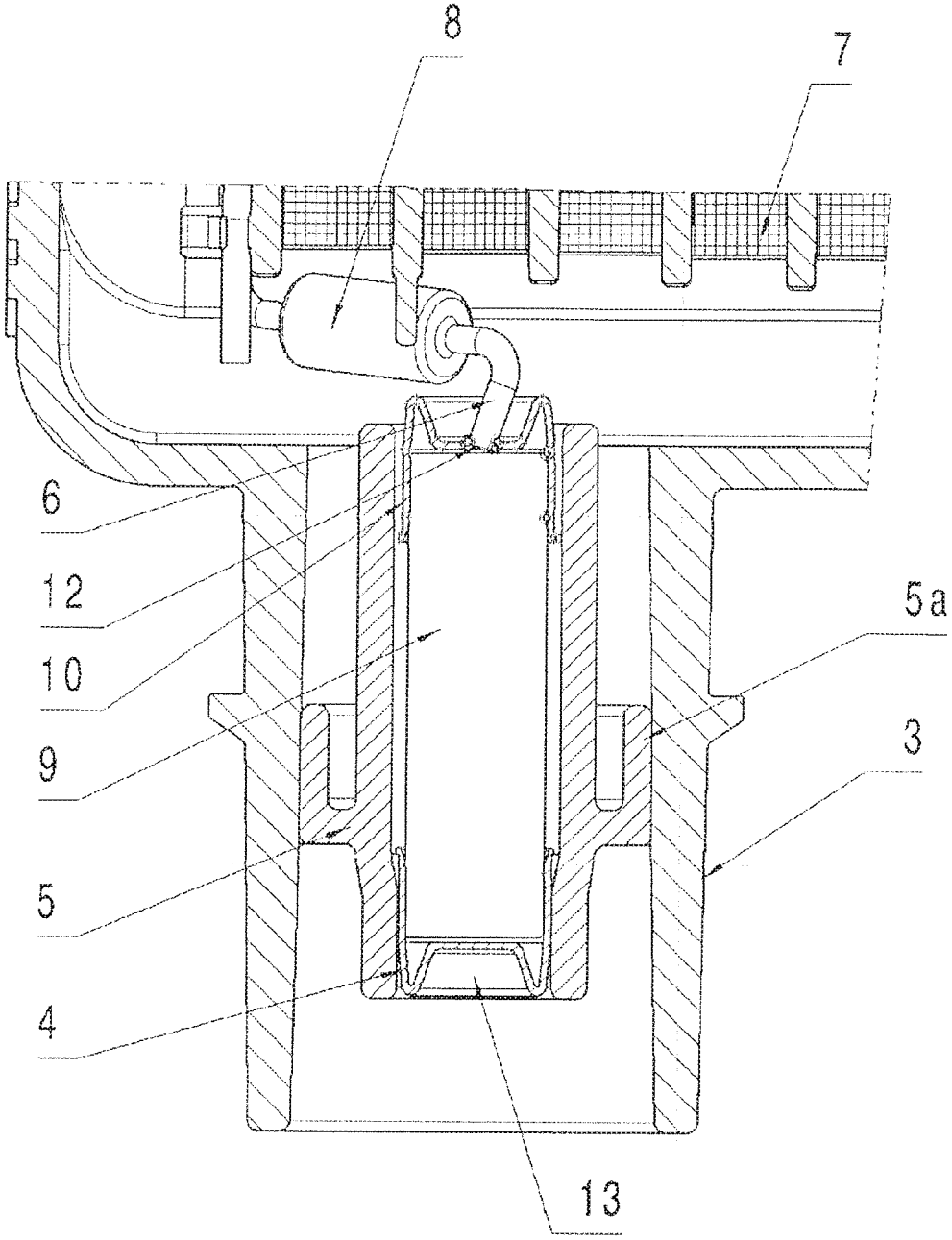
FIG. 2 is a schematic side view of a detail of the ignition coil shown in FIG. 1.

FIG. 2 shows a sectional view of the second plug connector 3. The second plug connector 3 is provided as a tubular section of the housing 1, which contains a rod-like high-voltage contact 4. The high-voltage contact 4 is connected by means of a wire 6 to the secondary side of a transformer 7 arranged in the housing 1. The wire 6 can be one of the two leads of a diode 8, which is arranged electrically between the high-voltage contact 4 and transformer 7.

Figure 3:
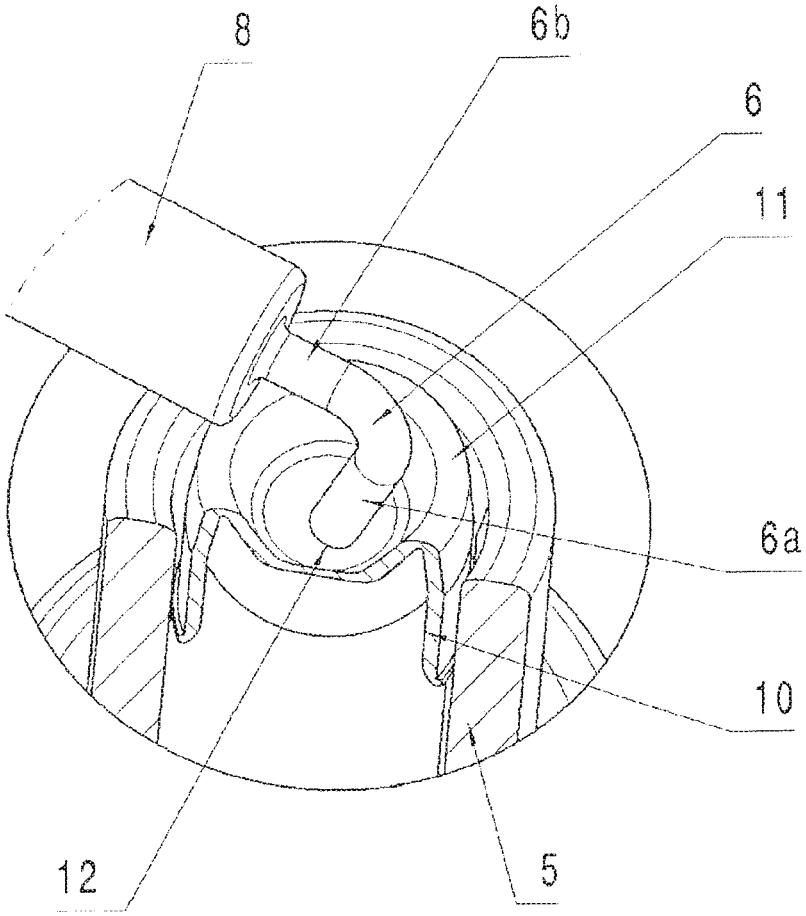
FIG. 3 is another view of the detail shown in FIG. 2.

The high-voltage contact 4 is arranged in an electrically insulating sleeve 5, placed in the tubular housing section. The high-voltage contact 4 may comprise an interference resistor 9. In the embodiment shown, the end of the high-voltage contact 4 facing the transformer 7 has a cap 10 made out of sheet metal, for example, a copper sheet, but can also be integrally designed. The cap 10 forms a contact surface against which the wire 6 presses, thereby establishing an electrical contact between the secondary side of the transformer 7 and the high-voltage contact 4. The cap 10 and wire 6 are also shown in the detailed view on FIG. 3.

The contact surface against which the wire 6 presses is concavely shaped, e.g., in the shape of the inside of a bowl or cup. For example, this can be achieved by having the cap 10 form a wall or an annular bead 11, which surrounds one end 12 of the wire 6. As shown on FIG. 3, the annular bead 11 rises towards the transformer 7, and surrounds the end 12 of the wire at a distance.

The end 12 of the wire 6 that presses against the contact surface or its end surface can be convexly rounded, for example, spherically rounded. This makes it possible to counteract the formation of field peaks. The wire 6 is bent in the shape of an L. An end section 6*a* that presses against the contact surface with the end 12 forms an acute angle with the plugging direction of the second plug connector 3, which is in the embodiment shown no more than 30°, for example, 20° or less. A section 6*b* running transverse to the end section 6*a* adjoins the end section 6*a*.

The end of the high-voltage contact 4 facing away from the transformer 7 can carry a cap 13, which is made out of metal sheet, for example, copper sheet. The cap 13 can be shaped just like the cap 11.

The ignition coil described above can be fabricated by attaching a piece of wire that is bent into an L-shaped, 6 to the secondary side of the transformer 7, for example, by connecting a diode 8 to the secondary side of the transformer 7, and bending a lead of the diode 8 into the shape of an L on the side of the diode 8 facing away from the transformer 7. The transformer 7 is then placed in the housing 1, so that an end section of the wire 6 forms an acute angle with the longitudinal direction of a tubular housing section, for example, an angle of less than 30°. A high-voltage contact 4 is then placed in the tubular housing section, so that a contact surface of the high-voltage contact 4 facing the transformer is pressed against the end section 6*a* of the wire piece 6, thereby establishing an electrical contact. For example, the high-voltage contact 4 can sit in an electrically insulating sleeve 5 made of plastic, which is pressed into the tubular housing section. To this end, the sleeve 5 can have a thickened region 5*a*, for example, a collar, and with this thickened region 5*a* abut against an inner surface of the tubular housing section.

The housing 1 can then be poured out with casting resin and sealed with a cover.

Figure 4:
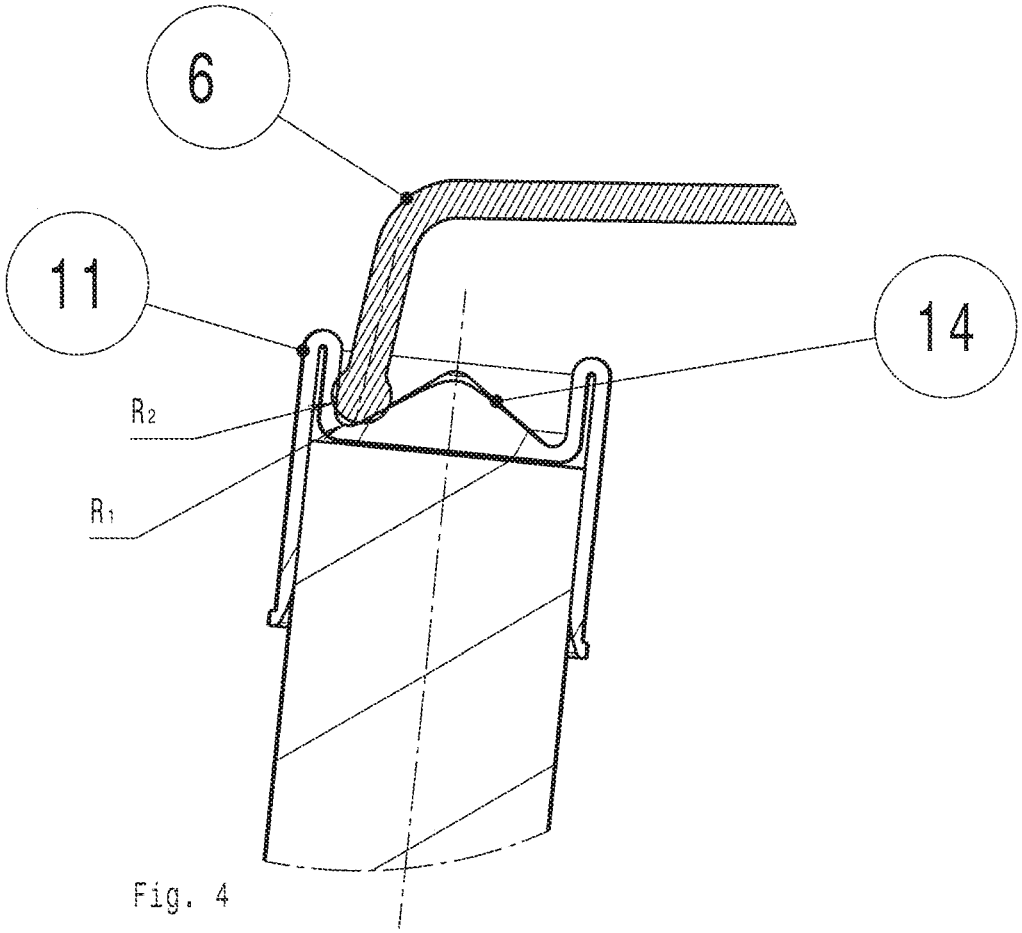
FIG. 4 shows schematically a detail of another embodiment.

FIG. 4 shows a detail view of another embodiment which differs from the embodiment discussed above mainly in that the wire 6 is resiliently pressed against an inside of the wall or bead 11 delimiting the contact surface. The contact surface is provided in the form of a groove or annular depression. The groove or annular depression can be provided by creating a central elevation 14 that is surrounded by a wall or bead 11. The central elevation 14 is much less steeply than the wall or bead 11. The radially inner wall of the groove is then less steep than the wall or bead 11 defining the radially outer wall of the groove. For example, the central elevation may be conical.

The groove or depression may narrow towards its bottom such that the wire 6 cannot touch the bottom of the groove or depression. For example, the width of the groove at or near the bottom may be smaller than the diameter of the wire or of a ball cap placed on the end of the wire 6. In FIG. 4, the radius R2 of the ball cap at the end of the wire 6 is larger than the radius of curvature at the bottom of the groove or depression.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

REFERENCE NUMERALS

1 Housing
2 Plug connector
3 Plug connector
4 High-voltage contact
5 Sleeve
5*a* Thickened region
6 Wire
6*a* End section of wire 6
6*b* Section of wire 6
7 Transformer
8 Diode
9 Interference resistor
10 Cap
11 Bead
12 End of wire 6
13 Cap
14 Elevation

What is claimed is:

1. An ignition coil, comprising:

a housing in which a transformer is arranged; and a plug connector;

wherein the plug connector comprises a high voltage contact connected to a secondary side of the transformer by a wire resiliently pressing against an electrical contact surface;

wherein the electrical contact surface is concavely shaped; and wherein the electrical contact surface comprises a circular groove and the wire is inserted into the groove.

2. The ignition coil according to claim 1, wherein an end surface of the wire presses against the electrical contact surface.

3. The ignition coil according to claim 1, wherein the wire presses a rounded end face against the electrical contact surface.

4. The ignition coil according to claim 1, wherein the high-voltage contact is a rod, which provides the electrical contact surface on its end facing the transformer.

5. The ignition coil according to claim 4, wherein the contact surface is provided as a cap placed on the rod.

6. The ignition coil according to claim 5, wherein the cap has an annular bead, which rises in the longitudinal direction of the rod and surrounds one end of the wire piece.

7. The ignition coil according to claim 4, wherein the rod contains an interference resistor.

8. The ignition coil according to claim 1, wherein the wire is a lead of a diode arranged between the high-voltage contact and secondary side of the transformer.

9. The ignition coil according to claim 1, wherein the wire is bent in the shape of an L, so that an end section of the wire pressing against the contact surface forms an acute angle with the plugging direction of the plug connector of less than 30°.

10. The ignition coil according to claim 1, wherein the electrical contact surface comprises a bottom and a wall or bead, wherein the wire is pressed against an inside of the wall or bead and against the bottom.

11. The ignition coil according to claim 1, wherein the groove narrows towards its bottom.

12. The ignition coil according to claim 11, wherein the groove narrows towards its bottom so much that the wire cannot touch the bottom.

13. An ignition coil, comprising:

a housing in which a transformer is arranged; and a plug connector;

wherein the plug connector comprises a high voltage contact connected to a secondary side of the transformer by a wire resiliently pressing against an electrical contact surface;

wherein the electrical contact surface is concavely shaped; and wherein a convex protrusion rises from the concave surface such that a groove is formed around the perimeter of the protrusion.

14. The ignition coil of claim 13, wherein the groove is circular.

* * * * *